US007089878B2

(12) United States Patent
Huang

(10) Patent No.: US 7,089,878 B2
(45) Date of Patent: Aug. 15, 2006

(54) RESILIENTLY EXPANDABLE CAUTIONARY STRUCTURE

(76) Inventor: Sunny E. L. Huang, 786 Via Monte Video, Claremont, CA (US) 91711

( * ) Notice: Subject to any disclaimer, the term of this patent is extended or adjusted under 35 U.S.C. 154(b) by 0 days.

(21) Appl. No.: 10/657,933

(22) Filed: Sep. 9, 2003

(65) Prior Publication Data

US 2004/0083943 A1 May 6, 2004

Related U.S. Application Data

(60) Provisional application No. 60/411,149, filed on Sep. 17, 2002.

(51) Int. Cl.
*E01F 9/12* (2006.01)

(52) U.S. Cl. ..... 116/63 C; 116/63 P

(58) Field of Classification Search ..... 116/63 T, 116/63 R, 63 P, 63 C; 40/612, 903; 404/6, 404/9

See application file for complete search history.

(56) References Cited

U.S. PATENT DOCUMENTS

| | | | | | |
|---|---|---|---|---|---|
| 2,275,711 | A | * | 3/1942 | Ybanez | 116/67 R |
| 2,762,328 | A | * | 9/1956 | Weig | 116/63 R |
| 2,954,005 | A | * | 9/1960 | Cioffi et al. | 116/63 R |
| 3,132,624 | A | * | 5/1964 | Shoemaker, Jr. | 116/63 R |
| 3,496,904 | A | * | 2/1970 | Rimkus | 116/63 R |
| 4,006,702 | A | * | 2/1977 | St. Cyr | 116/63 P |
| 4,197,807 | A | | 4/1980 | Campbell | |
| 4,256,050 | A | | 3/1981 | Barnard | |
| 5,305,705 | A | | 4/1994 | Gagliano | |
| 5,335,622 | A | * | 8/1994 | Say | 116/227 |
| 5,375,554 | A | | 12/1994 | Yen | |
| 5,413,825 | A | | 5/1995 | Chaikin | |
| 5,488,792 | A | * | 2/1996 | Kwok | 116/63 C |
| 5,566,638 | A | * | 10/1996 | Rokosny | 116/63 C |
| 5,613,798 | A | * | 3/1997 | Braverman | 116/63 C |
| D408,319 | S | | 4/1999 | Byers | |
| D421,810 | S | | 3/2000 | Rahman | |
| 6,048,590 | A | | 4/2000 | Phillips | |
| 6,109,764 | A | | 8/2000 | Shu | |
| 6,132,063 | A | | 10/2000 | Byers | |
| 6,139,168 | A | | 10/2000 | Gary et al. | |
| 6,164,304 | A | * | 12/2000 | Headley | 135/34.2 |
| 6,338,311 | B1 | * | 1/2002 | Ho | 116/63 C |

* cited by examiner

*Primary Examiner*—Diego Gutierrez
*Assistant Examiner*—Travis Reis
(74) *Attorney, Agent, or Firm*—Paul M Denk

(57) ABSTRACT

A spiral configured structure formed of metal or polymer is naturally biased into an erected and spiral arranged position, to form either a cone, a cylindrical structure, or other shaped structure, and which includes a series of lights, or a highly illuminated or phosphorescence dyed cloth, to act as a warning structure to the surrounding environment. The spiral structures can be contracted, into a flattened or near flattened configuration, and held by a fastening band, into closure. Various cross bracings or members are applied, at particular locations of the spiral structure, to provide it with reinforcement and rigidity at their upper and lower regions.

6 Claims, 4 Drawing Sheets

RESILIENTLY EXPANDABLE CAUTIONARY STRUCTURE

CROSS REFERENCE TO RELATED APPLICATION

This non-provisional patent application claims priority to the provisional patent application having Ser. No. 60/,411,149, which was filed on Sep. 17, 2002.

BACKGROUND OF THE INVENTION

Various types of cautionary or warning devices have been available in the art. For example, everyone is well acquainted with the orange polymer molded cones that are placed along the highway, generally at construction sites, to warn the drivers that care must be exercised due to the presence of construction workers, emergency conditions, or other activity that requires a slow down and that careful attention be exercised by the drivers. Other types of cautioning devices may include flares, or other types of related means that alert the routine driver that care should be exercised.

The current invention provides a similar cautionary warning, but in an entirely different structure and way.

An example of various specific prior art available relating to the subject matter of this invention can be seen in the Campbell U.S. Pat. No. 4,197,807, which shows a collapsible traffic cone marker. This has a cylindrical base portion, an upwardly extending spiral reflective marker, capable of collapsing and nesting within the base portion.

The patent to Bernard, U.S. Pat. No. 4,256,050, shows another collapsible marker cone. It also utilizes a coil strip that may be pushed downwardly, into a flattened configuration, or pulled upwardly, into a cone shape.

The patent to Galiano, U.S. Pat. No. 5,305,705, shows a collapsible road marker and method. This device is also a spiral, having a coil spring that holds the spiral spring upwardly, and incorporates reflective members to provide a caution.

The patent to Yen, U.S. Pat. No. 5,375,554, shows a rocking road emergency warning sign. This device utilizes a coiled member, of spiral shape, and in which concludes a top cover at the top of the spiral shaped body.

The patent to Chaikian, U.S. Pat. No. 5,413,825, is upon an artificial Christmas tree.

U.S. Pat. No. 6,048,590 is upon another spiral Christmas tree construction.

The U.S. Pat. No. 6,109,764, involves the usage of LED lamps and a polarized socket assembly for a decorative lamp strings.

U.S. Pat. No. 6,132,063 shows an apparatus for arranging decorative lights. This is also some form of a Christmas tree mechanism.

The patent to Gary et al, U.S. Pat. No. 6,139,168, shows a decorative tree/light illuminator display system.

There is also a design U.S. Pat. No. Des. 408,319, upon a decorative light tree.

The patent to Rahman, No. Des. 421,810, shows a flat to spiral light set.

These are the known prior art.

SUMMARY OF THE INVENTION

This invention relates principally to a cautionary structure, but more specifically one that is fabricated from a resilient material, so that when it naturally expands it provides a quite freely visible and observable means to any nearby drivers, but that when the structure is not in use, can be easily collapsed and held into that position to facilitate its shipment or storage.

The essence of this invention is the provision of the use of highly resilient or spring style of steel, or perhaps even molded polymer, in strip form, that may be in its natural state, shaped either into the expanded configuration of a cone, a spiral, or even cylindrically expandable, height wise, in order to furnish some degree of height to the structure of this device can be easily seen by drivers, when used as a highway, street, or other warning type of member.

In the preferred embodiment, the structure will have a base member that generally holds the bottom rung of the structure in its natural diametrical and angular shape, and upon the member may be applied, in the preferred embodiment, a battery pack that will be used to illuminate the various lights provided upon the height and length of the spirals for the structure as when it undertakes its natural steady state, and functions as a warning device. At the upper rung of the spiral, a further cross brace links diametrically between the upper end of the device, and has applied thereto a fastening means, such as a strap, which when the spiral is forcefully collapsed, into a generally flattened configuration, the strap may extend around the entire device and connect into position to hold the structure as during transit, storage, as when not in use.

The uniqueness of this device is the inclusion of the illumination means, which may comprise light emitting diodes, a strand of lights, or other illuminating means, which when a switch is initiated, from the battery pack, the lights are fully illuminated, so as to furnish a highly visible caution to any driver in the vicinity, particularly at night, that extreme care must be undertaken, in driving any further, due to either construction, emergency, that a car has broken down, or the driver needs help, as is so understandable to those that drive the highway. A switch between the battery pack, and the strand of lights, provides for their instant illumination, or de-energization, as when not in use. Furthermore, it is likely that the lights may be illuminated from hard wiring to a source of electricity, but that somewhat reduces the portability of the cautioning structure, particularly when used upon the roadway.

The structure of this device may also include a cylindrically spiraling member, that is generally vertically in orientation, when naturally extended, but which may be forced against its resistance, into a flattened configuration, and held by a fastening means, into closure, as when stored. Such a device may or may not include the same type of lighting, as previously described, in order to enhance the efficiency of its usage or, it is likely that the cylindrically spiral structure could be covered with a highly colored cloth, such as an orange mesh cloth, which may be dyed or treated with a phosphorus material, so as to provide a bright glow and function to warn those driving by, that care must be taken.

In addition, and regardless whether the cautioning device is of a cone shaped spiral, or a cylindrically shaped spiral, or to any other shape that can be naturally expanded, and retain that position during usage, various types of bands, support struts, or cross bracing, will aid in the shaped configuration of the device, and particularly at its base, or its upper edge, to maintain that expanded shape, as during usage. In the alternative, when the structure is collapsed into a flattened or reduced size, some type of fastening means can be employed to hold the structure as contracted, for its carrying, storage, or transit, as when not in use.

As previously alluded to, the types of materials that can be used to fabricate the basic structure of these spirals can be either spring steel, a resilient polymer, or any other type of material that exhibits inherent resiliency, and can be manipulated between a useful position, and a contracted structure as during non use, when employed.

It is, therefore, the principal object of this invention to provide a naturally extended spiral, either of a cone or cylindrical shape, or other shape, and which can be used for a cautionary device, or contracted as when not applied.

Another object of this invention is to provide a resilience spiral that incorporates various bracings that assure shaped configuration for the structure either during usage or non usage.

Yet another object of this invention is to provide a cautionary spiral device which incorporates a retention means for use for holding a resilient cautionary device as when contracted as when not employed.

Still another object of this invention is to provide a spiral cautionary device that may include means for illuminating various lights, to add to the viewability of the structure when employed.

Yet another object of this invention is to provide a resilient sub structure, in spiral form, and which can have a brightly colored cloth or mesh applied thereto, to warn anyone nearby that caution must exercised.

These and other objects may become more apparent to those skilled in the art upon review of the invention as described herein, and upon undertaking a study of the description of its preferred embodiment, when viewed in conjunction with the drawings.

DESCRIPTION OF THE PREFERRED EMBODIMENT

Figure 1:
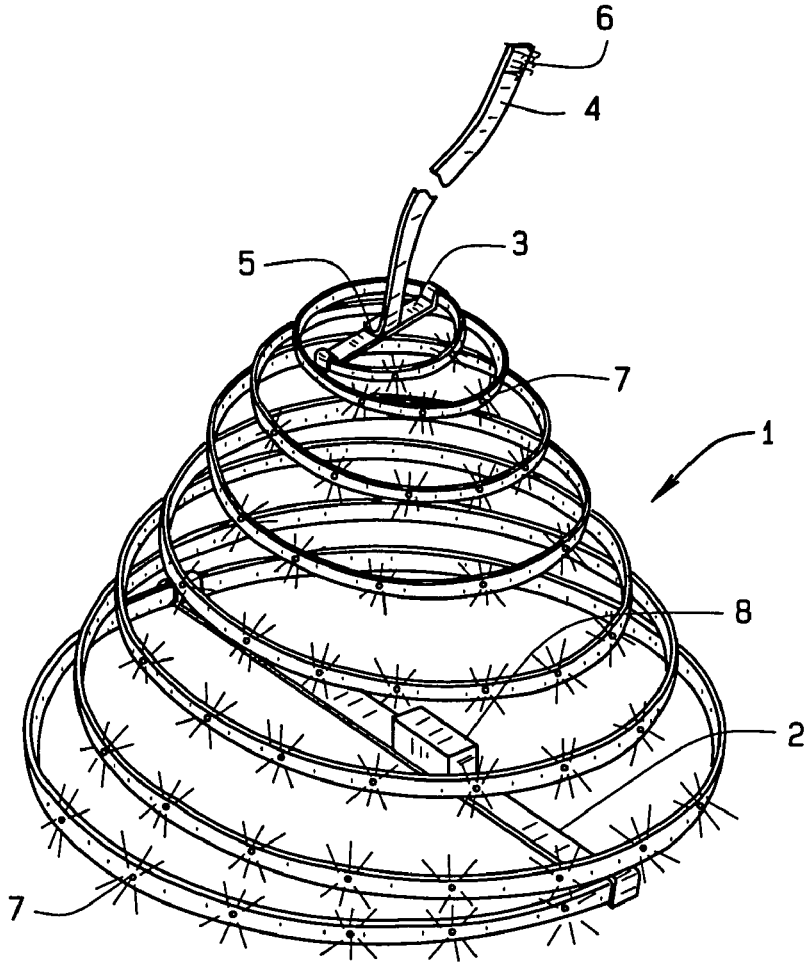
FIG. 1 provides a perspective view of the cone shaped resiliently expandable cautionary structure of this invention.

Referring to the drawings, and in particular FIG. 1, the resiliently expandable cautionary structure 1 of this invention is readily disclosed, in its usable configuration. As can be seen, it includes a structure fabricated of reasonably thin spring steel, or perhaps even a resilient polymer, and which is spiraled in configuration, shaped as a cone, as noted.

At the lower end of the structure is a base member 2, which spans the dimension generally diametrically across the bottom rung of the structure, and therein adds reinforcement to maintain the generally angular shape of the spiral structure, at its base location.

At the upper end of the spiral, there is provided a cross brace 3, which likewise holds the structural integrity of the upper end of the spiral, as can be noted. Obviously, either the base member 2, or the cross brace 3, can be configured to any shape, can comprise a disc, a cross type bracing, or to any other shape, that integrally forms and holds the upper and lower segments of the structure into their spiraling configurations, and to add reinforcement to it, as during usage.

Connecting with the upper cross brace 3 is a fastening means 4, which in this particular instance may comprise a strap, secured to the cross bracing at one end, and having a layer of hook or pile fastening means 5 provided thereon. The opposite end of the strap includes the other segment of the hook and pile fastening means 6, such that when the structure is collapsed, against its inherent resiliency to maintain its spiraling orientation, and generally pushed into a flattened configuration, the strap 4 circumvents or surrounds the flattened structure and adheres the same into that configuration, that facilitates its transit, or storage, as when not in use.

As can also be noted in FIG. 1, there are provided illuminating means, such as the lights 7 along the entire reach of the spiral, and which when illuminated to some coloration adds further notice to those in the vicinity that caution should be undertaken, similar to that which is achieved from usage of the standard orange cones, readily recognizable as used upon the roadway at construction sites, at emergency locations, and the like. These illuminating means may comprise light emitting diodes, LEDS, or other type of illumination means, or even fiber optic glowing structure, that can be held adjacent to the spirals of the structure, and add further illumination to the brilliancy of the structure, when employed.

A battery pack, as at 8, may provide the energy necessary to light the LEDS, or the device could even be hard wired into a source of electrical energy, as desired. For example, the assembly of the lights into the system may be provided by forming a more flexible type of resilient plastic tube, that forms the spiral structure, may be oval in configuration, and have the LED lights and its wiring or strand arranged within the spiral, to provide illumination as required and desired. The hollow polymer may be formed transparent, so the lights can be readily observed, or the lights may extend therethrough. Or, it is also likely that once the spiral structure is expanded, a column of lights may be extended upwardly through the center of the spiral, secure to the cross member, and be electrically connected to the battery pack, to illuminate the centrally arranged strand of lights provided therein.

Figure 2:
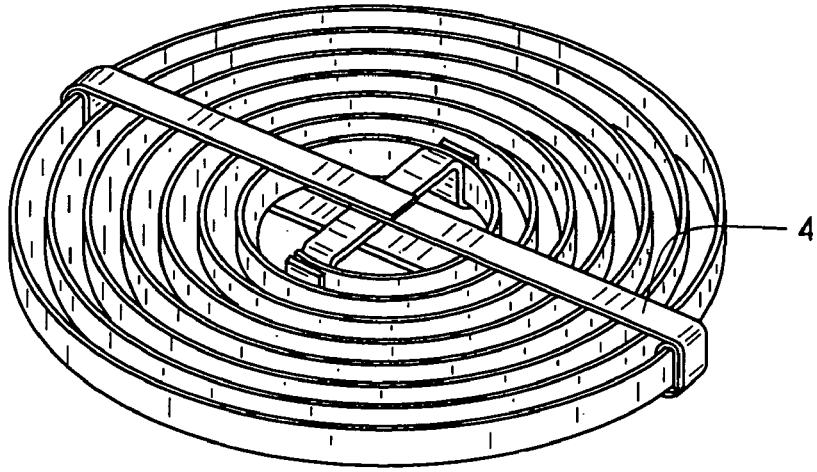
FIG. 2 discloses the structure of FIG. 1 when contracted into a non usable condition.

Furthermore, it is just as likely that a brightly colored cloth, or mesh, perhaps to an orange coloration, could be applied to and draped around the spirals of the structure, to provide for some degree of warning, and which also can be readily collapsed with the structure, when pushed into its flattened configuration, as noted in FIG. 2.

In the preferred embodiment, the spiral structure, whether fabricated of metal, polymer, or the like, may have a general configuration, more or less, of approximately a one eighth inch (⅛") width, and a one thirty second or one sixteenth inch (1/32" or 1/16") thickness, having inherent resiliency, and pre bent into the configuration of an expanded spiral, either in cone shape, or cylindrically shaped, as readily disclosed in this application, or may even be barrel shaped or the like. Obviously, band type material of other thicknesses, or widths, could likewise be used, depending upon the degree of structural strength required in light of the ruggedness of the situation in which this structure is used, when employed for the identified purposes.

Figure 3:
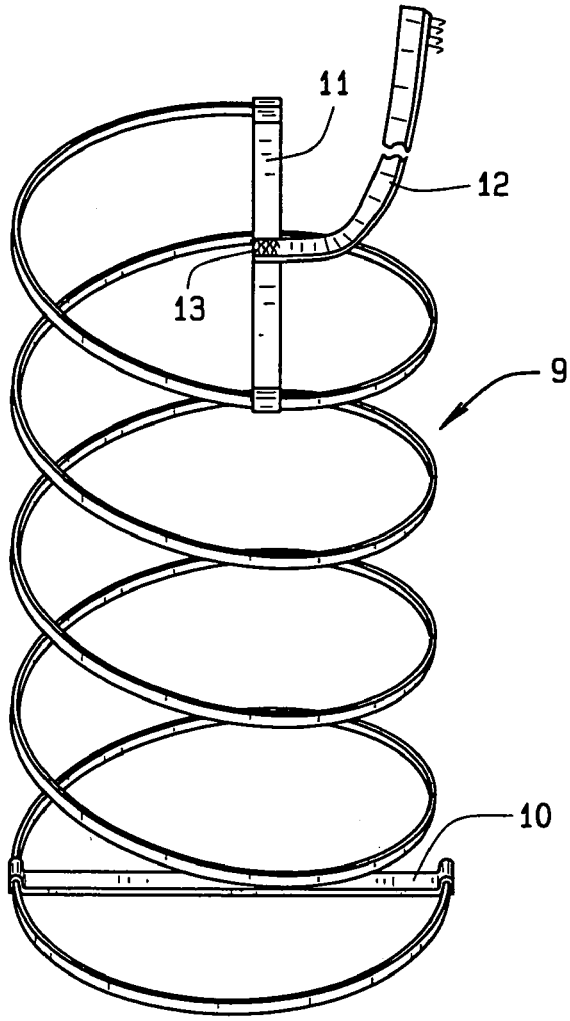
FIG. 3 discloses a cylindrically expandable resilient structure that may also function as a cautionary device.
Figure 4:
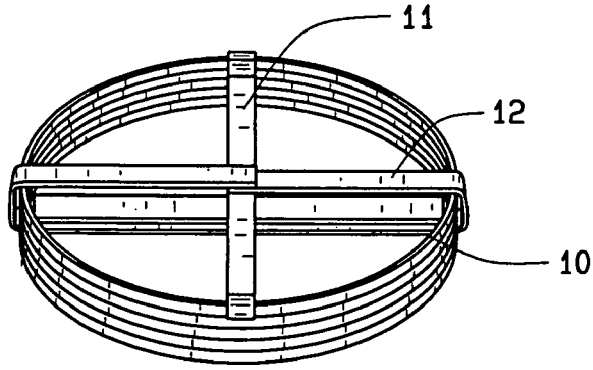
FIG. 4 shows the structure of FIG. 3 when contracted, and fastened into closure, during non usage.

A further embodiment of the structure of the expandable cautionary device of this invention is also disclosed in FIGS. 3 and 4. This device is a cylindrically shaped member 9 that is spiral in configuration, as noted, and is assembled from the same type of band of spring steel, or resilient polymer, to naturally undertake the configuration of the expanded cylinder as shown in FIG. 3. In addition, a base member 10 is provided across the bottom, to add structural strength and integrity to the base of the device. A cross brace is provided at 11, to add structural strength at the upper end of said device. In addition, as can be noted, a strap 12 similar to the strap 4 as previously described, is attached at the approximate center 13 of the cross brace 11, such that when the spiral structure is collapsed, as can be seen in FIG. 4, the strap 12 can be wrapped around the contracted structure, and hold it in its closed condition, as noted.

Obviously, other types of fastening devices other than the straps as shown at 4 and 12 may be employed, they may be metal straps, they may be some form of metal clip that connects between the cross brace 11, and the base member 10, to hold the structure in its collapsed condition. This could be any type of a clip that connects between these two components, or any type of a wrap, that can be applied to hold the cross braces 3 or 11, in close proximity with the base embers 2 or 10, to maintain their contraction, as shown in FIGS. 2 and 4 of this disclosure.

Figure 5:
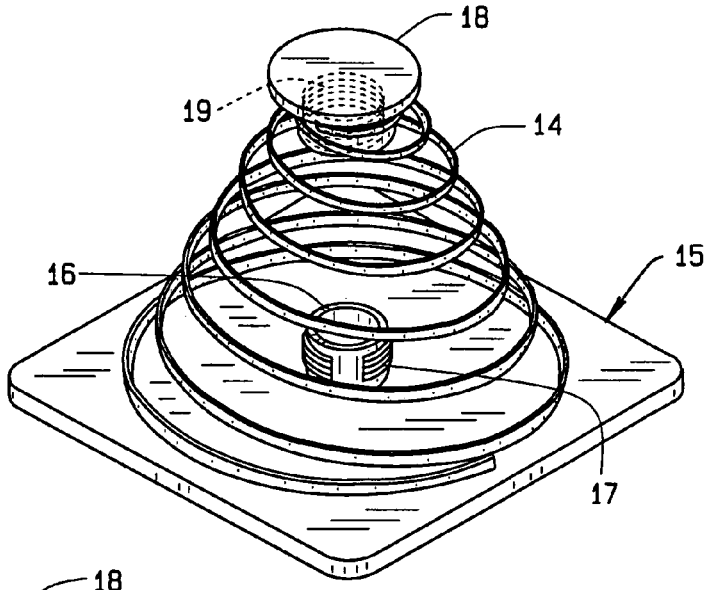
FIG. 5 describes a perspective view of the cone shaped resiliently expandable structure with an alternate fastening means.

Turning to FIG. 5, a further embodiment of the expandable cautionary structure 1 has a form similar to FIG. 1 and an alternate fastening means. In this embodiment, a spiral shaped structure 14 attaches to a base member 15. The structure 14 is assembled from the same type of band of spring steel or resilient polymer to assume naturally the configuration of the conical spiral as shown in FIG. 5. The base member 15, generally rectangular and steel, supports the bottom of the structure 14 and stabilizes the structure 14 against tipping. Further, the base member 15 has a centered male fitting 16, the first of a two-part fastening means. The male fitting 16 engages a female button 18, the second part of the fastening means, located upon the apex of the structure 14. In this embodiment, the male fitting 16 and female button 18 have cooperating round shapes and are formed of the same material as the base member 15. Here, the male fitting 16 has external threading 17 that engages internal threading 19 within the female button 18.

Figure 6:
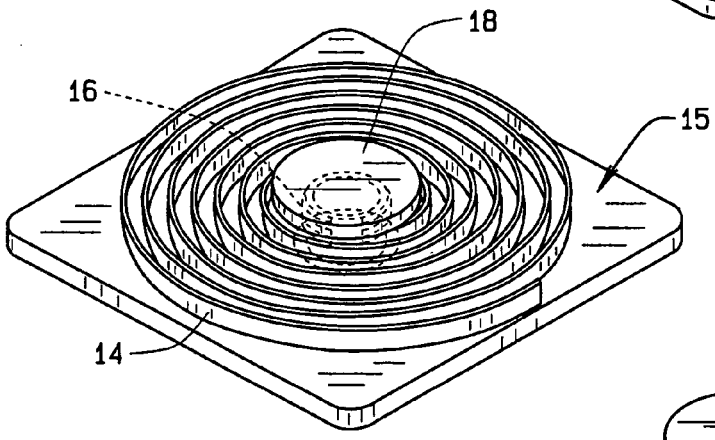
FIG. 6 shows the structure of FIG. 5 when contracted and fastened into a non-usable condition.

To collapse the expandable cautionary structure 1, a user presses the female button 18 towards the male fitting 16 and base member 15. When the female button 18 contacts the male fitting 16, the user turns the female button 18 to engage the threadings 17, 19 and secure the structure 14 in a compact form as shown in FIG. 6. The structure 14 lays flat against the base member 15 with the female button 18 upon the centered male fitting 16. A user can then store multiple expandable cautionary structures 1 upon one another.

Figure 7:
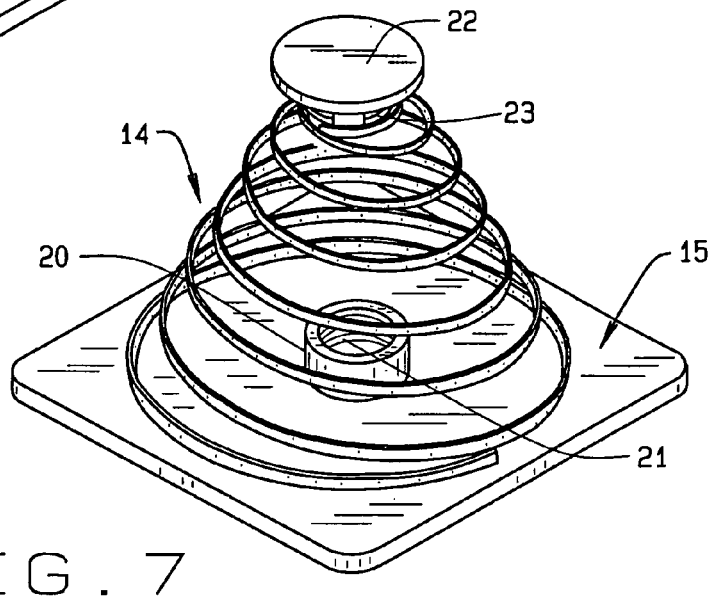
FIG. 7 shows the structure of FIG. 5 with a further alternate fastening means.

FIG. 7 shows the expandable cautionary structure 1 of FIG. 5 but with a further alternate fastening means. In this embodiment, the base member 15 has a centered female fitting 20 as the first of the two-part fastening means. The female fitting 20 engages a male button 22, the second part of the fastening means, located within the apex of the structure 14. In this embodiment, the female fitting 20 and male button 22 have cooperating round shapes and are formed of the same material as the base member 15. Here, the female fitting 20 has internal threading 21 that engage external threading 23 within the male button 22. Though FIGS. 5 and 7 show cooperating threads between a fitting and a button; other types of two part fastening means may be used such as bayonet locks, snap buttons, or the like.

Figure 8:
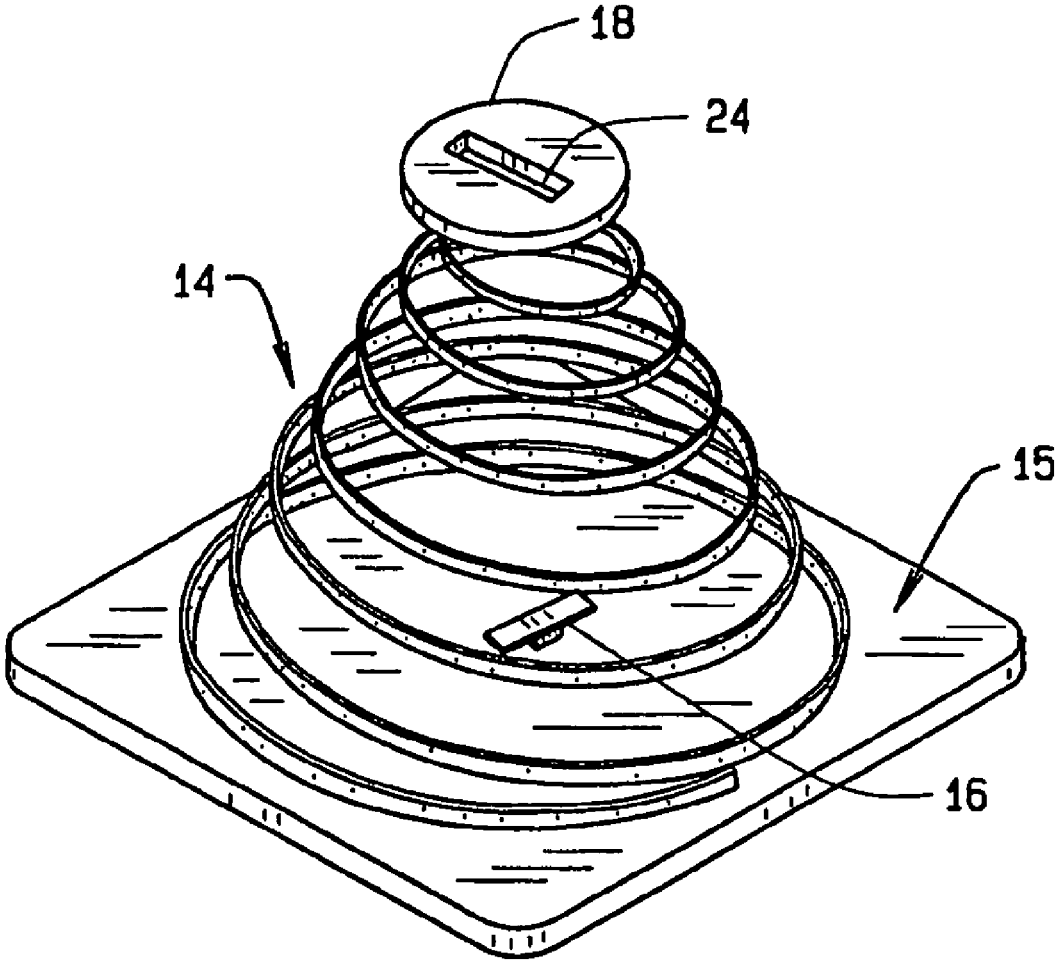

FIG. 8 shows the expandable cautionary structure 1 of FIG. 5 but with a further alternate fastening means. In this embodiment, a bayonet lock secures the button 18 and collapsed spiral 14 to the base member 15. The button 18 has a generally centered slot 24 that admits a fitting 16. The fitting 16 attaches to the base member 15 and has an upright T shape that passes through the slot 24 when aligned with the slot 24. Pressing the button 18 towards the base member 15, the fitting 16 is placed through the slot 24. Upon rotating the button 18 to misalign the slot 24 with the fitting 16, the button 18 rests against the fitting 16 and secures the collapsed spiral 14 against the base member 15.

In addition, the various illuminating means as shown and described for this invention can be any type of a light source, even a flashlight kind of light, placed at strategic locations around the spiral, and illuminated by the battery pack 8, or otherwise. The lights may also blink. Furthermore, as previously alluded to, any type of brightly colored cloth, such as an orange cloth or mesh, can be draped around and adhered to the spirals, such that when the structure is expanded, as shown in FIGS. 1 and 3, furnishes a very clear warning to those in the vicinity. And, even with the cloth applied thereto, the spirals may be contracted or collapsed, as shown in said FIGS. 2 and 4, for storage.

Variations or modifications to the subject matter of this invention may occur to those skilled in the art upon review of the disclosure as provided herein. Such variations, if within the spirit of this development, are intended to be encompassed within the scope of the invention as shown and described. The depiction of this invention as described herein, and as shown in the drawings, is provided for illustrative purposes only.

The invention claimed is:

1. A resiliently expandable cautionary structure, comprising:

a structure, having an inherent spiral configuration formed of a band of resilient material;

a base member, having a span of at least the largest diameter of said structure, and joining said structure at one or more points;

a cross brace, having a span of at least the narrowest diameter of said structure, joining said structure at two or more points, and located opposite said base member, said cross brace securing temporarily to said base member;

a strap having sufficient length to span at least the diameter of said structure when collapsed, a width narrower than the width of said base member, and a fixed end joining said cross brace and the opposite end free, co-operating hook and pile fasteners with one segment of said hook and pile located at the fixed end of said strap and a second segment of said hook and pile located at the free end of said strap, whereby said strap extends from said cross brace, wraps the diameter of said structure when contracted, returns to said cross brace, and said second segment secures to said first segment;

an illuminating means, integral to said band and regularly arrayed at least partially along said band and is one of light emitting diodes or fiber optic glowing devices; and, a battery pack connecting to said illuminating means, locating upon said base member, and providing energy for said illuminating means.

2. The structure of claim 1 wherein said structure has one of a generally conical shape with the largest diameter of the conical shape upon said base member or a generally cylindrical shape with said base member and said cross brace each spanning at least the diameter of said structure.

3. The structure of claim 1 wherein said strap is selected from the group consisting of leather, metal, polymer, rubber, rope, and elastic.

4. The structure of claim 1 wherein said structure is formed of polymer material.

5. A resiliently expandable cautionary structure, comprising:

a structure, having an inherent spiral configuration formed of a band of resilient material;

a base member, having a span of at least the largest diameter of said structure and a generally centered fitting, and joining said structure at one or more points;

a button, having a span of at least the narrowest diameter of said structure, able to be rotated about the vertical axis of said structure, and located atop said structure and opposite said base member, said button securing temporarily to said base member;

said fitting and said button cooperating by one of said fitting having a generally cylindrical shape and internal threading that engages with external threading of said button, or said fitting engaging said button as a bayonet lock;

an illuminating means, integral to said band and regularly arrayed along at least some length of said band and is one of light emitting diodes or fiber optic glowing devices; and, a battery pack communicating with said illuminating means, locating upon said base member, and providing energy for said illuminating means;

whereby said button cooperates with said fitting to releasably secure said structure in a contracted position.

6. The structure of claim 5 wherein said structure is one of a generally conical shape with the largest diameter of the conical shape proximate to said base member and said button is located in the apex of the conical shape, or a generally cylindrical shape having external threading that cooperates with internal threading of said button.

* * * * *